US006725699B1

(12) United States Patent
Müller

(10) Patent No.: US 6,725,699 B1
(45) Date of Patent: Apr. 27, 2004

(54) METHOD FOR CIRCULARY BENDING A SHEET AND MULTICYLINDER DEVICE FOR CARRYING OUT THE METHOD

(75) Inventor: Eugen Müller, Dietikon (CH)

(73) Assignee: Elpatronic AG, Bergdietikon (CH)

( * ) Notice: Subject to any disclaimer, the term of this patent is extended or adjusted under 35 U.S.C. 154(b) by 0 days.

(21) Appl. No.: 09/914,939

(22) PCT Filed: Feb. 7, 2000

(86) PCT No.: PCT/CH00/00065

§ 371 (c)(1),
(2), (4) Date: Jan. 23, 2002

(87) PCT Pub. No.: WO00/53353

PCT Pub. Date: Sep. 14, 2000

(30) Foreign Application Priority Data

Mar. 5, 1999 (CH) ..... 0410/99

(51) Int. Cl.[7] ..... B21D 5/14

(52) U.S. Cl. ..... 72/169; 72/166; 72/133; 72/370.01

(58) Field of Search ..... 72/175, 173, 170, 72/169, 370.01, 368, 96, 51, 133

(56) References Cited

U.S. PATENT DOCUMENTS

| | | | | | |
|---|---|---|---|---|---|
| 2,719,562 | A | * | 10/1955 | Beegle | 72/134 |
| 3,879,994 | A | * | 4/1975 | Hume | 72/127 |
| 3,899,911 | A | * | 8/1975 | Ogier et al. | 72/169 |
| 4,428,215 | A | * | 1/1984 | Hume | 72/133 |
| 4,491,004 | A | | 1/1985 | Ivanoff | |
| 4,606,208 | A | * | 8/1986 | Williamson | 72/133 |
| 4,628,721 | A | * | 12/1986 | Williamson | 72/96 |
| 4,706,488 | A | | 11/1987 | Williamson | |
| 5,115,658 | A | | 5/1992 | Kirchhoff et al. | |

FOREIGN PATENT DOCUMENTS

| | | |
|---|---|---|
| FR | 2 140 317 | 1/1973 |

* cited by examiner

*Primary Examiner*—Daniel C. Crane
(74) *Attorney, Agent, or Firm*—McCormick, Paulding & Huber LLP

(57) ABSTRACT

According to the present invention, a method and an apparatus for rounding a sheet or plate blank in a rounding apparatus having rounding rolls is provided. A predetermined second part region of the blank is rounded after a predetermined first part region has been rounded. A feed direction of the blank for the rounding of the second part region is selected such that rounding in the second part region proceeds towards the previously rounded first part region.

11 Claims, 3 Drawing Sheets

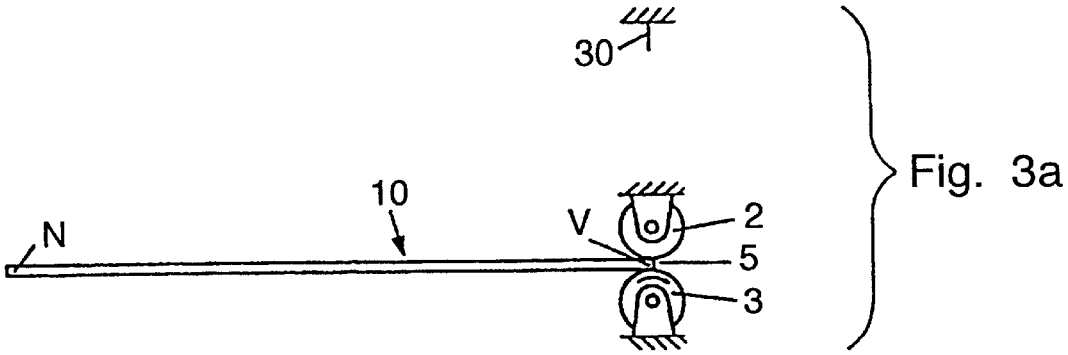
Fig. 3a
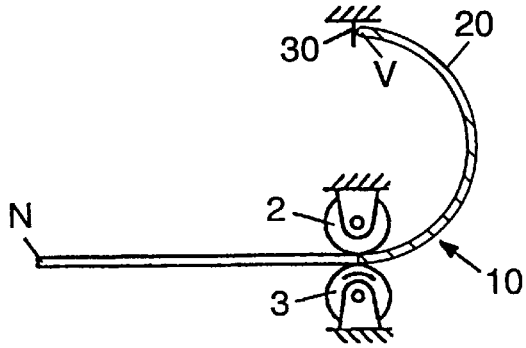
Fig. 3b
Fig. 3c
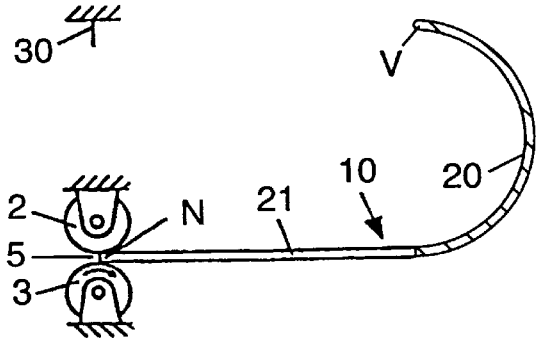
Fig. 3d
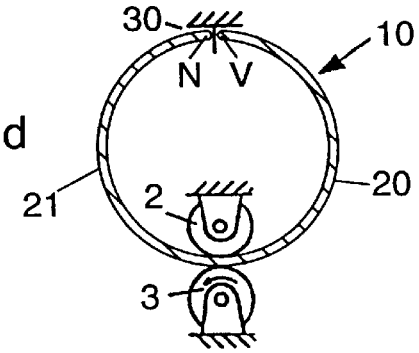

METHOD FOR CIRCULARY BENDING A SHEET AND MULTICYLINDER DEVICE FOR CARRYING OUT THE METHOD

This application is entitled to the benefit of and incorporates by reference essential subject matter disclosed in PCT International Application No. PCT/CH00/00065 having an International Filing Date of Feb. 7, 2000, and Swiss Patent Application No. 410/99 filed Mar. 5, 1999.

BACKGROUND OF THE INVENTION

1. Technical Field

The present invention relates to a method for rounding a sheet-metal blank and a multi-roll rounding machine for carrying out the method.

2. Background Information

Rounding processes are used to bend sheet-metal parts for the manufacture of, in particular, tubular bodies, such as ducts or filter cases, which after rounding are fed to an ensuing processing station for permanent joining of the adjacent longitudinal edges. Sheet-metal blanks for the stated purpose may have various configurations, as, for example, those for ducts may have cutouts for subsequent connection of a branch pipe, or those for filter cases may be provided with a sieve structure, making processing difficult and imposing considerable demands on the rounding operation. Such sheet-metal blanks typically have a thickness of 0.3 to 3 mm, and the diameter after rounding lies between 25 and 500 mm. But thinner (or thicker) blanks are also processed by rounding machines into bodies with other diameters.

To round sheet-metal blanks of the above-described kind, e.g. three-roll rounding machines are used, with which the blanks are bent around a rounding roll as two guide rolls, spaced apart from one another but working in conjunction with the rounding roll, press the blanks against a segment of the rounding roll as the blanks pass through, so producing plastic deformation. It has been found that on a three-roll rounding machine the blank is insufficiently deformation. It has been found that on a three-roll rounding machine the blank is insufficiently rounded e.g. in the leading edge region, as, when the blank is led in, it is initially only seized between the rounding roll and the first guide roll, and is not rounded, or is not rounded sufficiently, until the leading edge reaches the second guide roll, at which point the plastic deformation process commences. This is particularly critical in the case of blanks which have a relatively large cutout at the leading edge, so that the laterally adjacent regions are then overstressed and tend to buckle.

Accordingly the two guide rolls have been reduced in diameter with a view to shortening the distance between their axes and hence the length of the region of insufficient rounding. The attendant risk of deflection of the guide rolls has been countered by a fourth roll that supports the guide rolls as a back-up roll on the opposite side to the path of the blank, and thus prevents undesired deflection. This four-roll rounding machine possesses improved characteristics, but fails to solve the fundamental problem of insufficient rounding of the leading portion of the blank.

At the end of its pass through the rounding machine, the leading edge of the blank is caught on a catch rail with suitably formed grooves, as is, after rounding is complete, the trailing edge of the blank, which then snaps onto the catch rail elastically, so that the rounded blank can be shifted along the catch rail to the ensuing processing station.

There are also known two-roll rounding apparatuses in which a sheet-metal blank is rounded between a rounding roll and a single guide roll provided with a compressively elastic coating. Unlike the above-mentioned three or four-roll rounding technique, such rounding methods do allow faultless rounding of a sheet-metal blank. If the rounding rolls are periodically moved apart during the rounding operation as feed continues without interruption, straight regions are left between the bends. For example, a sheet-metal body with a triangular profile can be produced in this way. In the present description, such designs are also called, by analogy, "tubular". At the end of the rounding cycle, the leading edge is again located immediately before the point of run-in to the rounding rolls.

To obtain complete, and hence high-quality, rounding, the rounded sheet-metal parts are removed axially from the rounding roll, and are not trapped in a catch rail. A catch rail will of course be located as near to the run-in point as possible, but for geometrical reasons it may lie only approximately in the path of the leading edge, and not at the end of that path but further back. This then causes a spreading-apart of the rounded blank at the end of the rounding operation, which, in view of the precise rounding achieved by the two-roll machine and depending on the subsequent application of the sheet-metal body, is detrimental.

However, with axial withdrawal of the rounded blank, in contradistinction to the catch rail that also serves as guide rail for onward transport of the blank, the orientation of the sheet-metal body, that is to say the position of the edges to be subsequently joined, is lost. A two-roll rounding machine will therefore usually have a downstream working station that re-establishes the orientation of the sheet-metal bodies so that they can be arranged on a transport rail. A further snag with axial withdrawal, especially in the case of thick sheets, is the risk of damaging the relatively soft, and hence vulnerable, compressively elastic coating of the rounding roll. These known two-roll apparatuses have proved to be technically complex, and moreover costly.

Therefore the fundamental problem of the present invention is to specify a method for rounding sheet-metal blanks which does not have the above-stated drawbacks, that is to say one which yields and improved rounding quality combined with a definite orientation of the sheet-metal body for subsequent processing, simply and without requiring an additional processing station.

DISCLOSURE OF THE INVENTION

According to the present invention a method and an apparatus for rounding a sheet or plate blank in a rounding apparatus having rounding rolls is provided. A predetermined second part region of the blank is rounded after a predetermined first part region has been rounded. A feed direction of the blank for the rounding of the second part region is selected such that rounding in the second part region proceeds towards the previously rounded first part region.

For the purposes of the description of the invention, the term "leading edge" refers to the edge which is seized first at the run-in, and "trailing edge" the opposite edge, of a sheet-metal blank making a conventional pass through a rounding apparatus. This terminology will be retained even where the leading edge is actually trailing because the feed direction has been reversed in accordance with the invention. "Forward feed" is the direction in which the blank is [moving when] seized by its leading edge at the run-in point, while the opposite direction is called "reverse feed".

The effect of rounding part regions of the sheet-metal blank one after the other in a specific way, namely by running in opposite directions, is that the edges are brought to a final position that is not the same as with the conventional methods.

For example, with conventional methods, the leading edge, as stated, runs around the guide roll through a full 360°, owing to the one-way feed of the rounding apparatus; which also corresponds to the intention of producing a tubular body by a 360° rounding process, and then of joining the adjacent edges. After rounding, the leading edge is again located immediately before the run-in to the rounding rolls.

If the method according to the invention is used, the final position of the edges of the rounded body is different: When rounding of the second part region commences in the direction towards the first part region, the leading edge moves away from the run-in point, and runs backwards along its path. Complete rounding can be obtained with the edges in a universal and predeterminable position. This means that a catch rail can be positioned where there is no subsequent distortion of the perfectly rounded blank, with the result that the orientation of the blank is not lost, and an ensuing processing station is not needed.

In a preferred embodiment, the whole blank is rounded in two part regions. In the first part region, rounding proceeds from the leading edge to the center of the blank; the rolls are then parted until the trailing edge of the blank (whose feed continues) reaches the run-in point. With reverse feed, rounding of the second part region is then performed from the trailing edge towards the first part region. When the center of the blank is reached again, rounding is complete. The center of the blank, not the leading edge, now lies at the run-in point, and the edges lie opposite this point, on the other side of the rounding roll.

The effect of the embodiment which has been described above is obtained by rounding the second part region in accordance with the invention after the first part region has been formed. The direction of feed during rounding of the first part region is immaterial; it would be feasible to propel the blank through spaced-apart rolls as far as its center, to close the rolls, and then to round the first part region from the center to the "leading" edge. The direction of feed during rounding of the first and second part regions would then be the same.

These and other objects, features, and advantages of the present invention will become apparent in light of the detailed description of the present invention.

BRIEF DESCRIPTION OF THE DRAWINGS

The invention will now be described in detail with reference to the drawings. Only the elements essential for an understanding of the invention have been represented schematically in the drawings.

FIGS. 3*a* to 3*d* show one example for a blank to be rounded in accordance with the invention.

DETAILED DESCRIPTION OF THE INVENTION

Figure 1:
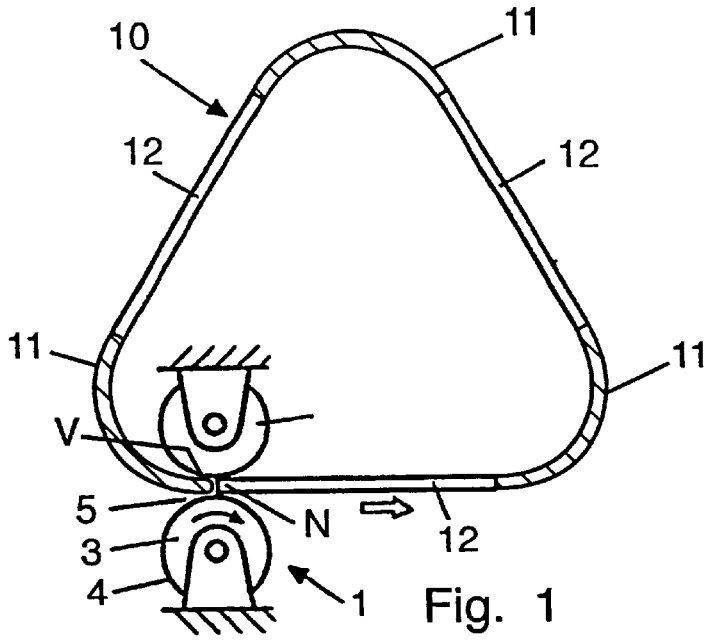
Fig. 1 Prior Art
FIG. 1 shows a rounding process according to the state of the art.

FIG. 1 shows a conventional two-roll rounding apparatus 1 with a rounding roll 2 and a guide roll 3. The guide roll possesses a compressively elastic coating 4 by which a sheet-metal blank 10 can be pressed against the rounding roll 2 so that the blank is brought to bear on the rounding roll 2 and is thereby plastically deformed. The sheet-metal blank 10 has a leading edge V and a trailing edge N. The trailing edge N is at the run-in point 5, and the leading edge V is immediately in front of it; the rounding cycle is complete. The direction of rotation of the rolls 2, 3 and the feed direction of the blank 10 are marked by arrows in the drawing.

In all figures, "forward feed" denotes the conveying direction of the blank 10 from left to right through the rounding apparatus 1, and "reverse feed" denotes the opposite direction.

The blank 10 has curved regions 11 (shown by thick black lines) and straight regions 12 (shown by double lines). The curved regions arise as rolls 2, 3 are pressed together, and straight regions as rolls 2, 3 are parted, as feed proceeds.

Figure 2:
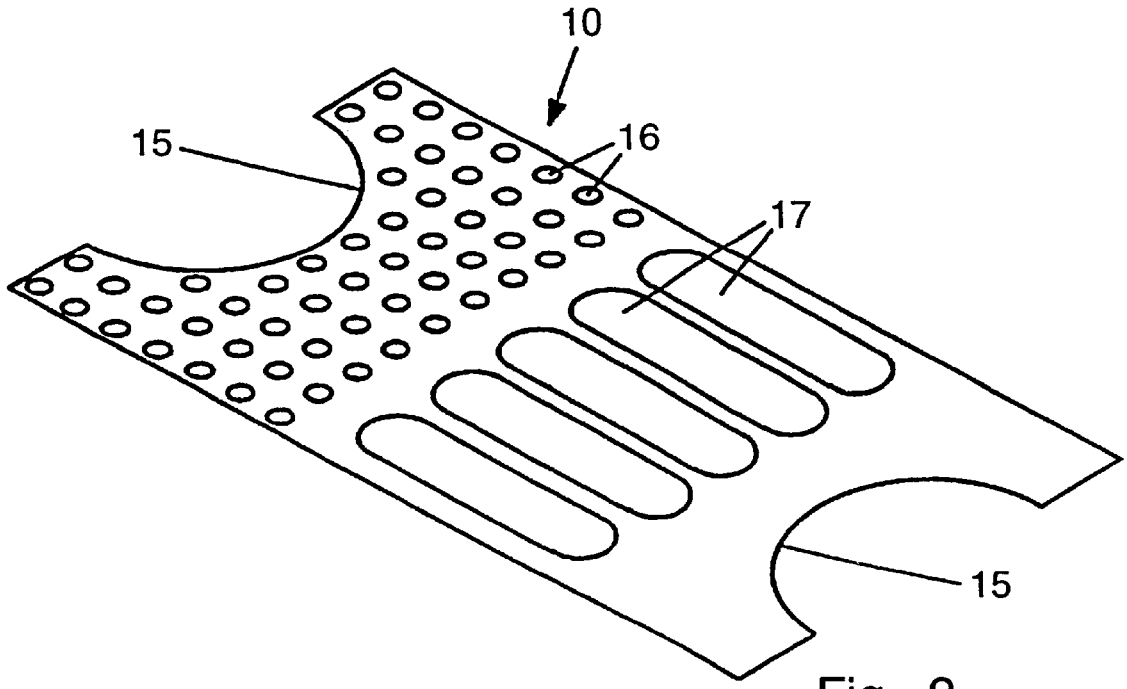
FIG. 2 shows a sheet-metal blank for rounding.

FIG. 2 shows a sheet-metal blank 10 prior to rounding, with cutouts 15 for a future branch pipe, a filter structure 16 and further cutouts 17. Such a blank is difficult to round and to guide, as the various structural features constitute areas of weakening or stiffening which, as irregularities, adversely affect the process.

FIGS. 3*a* to 3*d* show one example for the rounding cycle according to the invention. In FIG. 3*a* the blank 10 is positioned with its leading edge V in front of the run-in point 5.

In FIG. 3*b*, a first part region 20 (shown by a thick black line in the figure) of the blank 10 has already been rounded, while a second part region 21 (shown by double lines in the figure) has not yet passed through the rounding apparatus 1. The first part region 20 extends over half the length of the blank, so that the curve obtained is a semicircle.

In FIG. 3*c*, forward feed has continued until the trailing edge N has arrived at the run-in point 5. However, no bending of the second part region 21 has taken place, because the rolls 2, 3 have been kept apart during feed.

FIG. 3*d* shows the blank 10 after completion of the rounding cycle. The second part region 21 has been rounded from the trailing edge N with reverse feed, with rounding starting at the edge N and proceeding towards the first part region 20 until rounding of the second part region was complete.

Also in FIGS. 3*a* to 3*d*, a device 30 for defining the position of the edges V and N is schematically shown. The device 30 maintains the position of the edges V and N when the blank 10 is removed e.g. axially from the rounding apparatus 1 for further processing. Since the edges V and N are not located close to the run-in point 5 on completion of rounding, the device 30 can be arranged in the path of the edges V and N, so that distortion of the rounded blank 10 does not occur.

The device 30 can be placed at any desired point on the path of the edges V and N. The possibilities are limited only by the space occupied by the device 30 in regard to its proximity to the run-in point 5. Also, the device 30 can be provided with guide grooves for the edges V and N or other guide means (these are not shown in the figures).

Figure 4A:
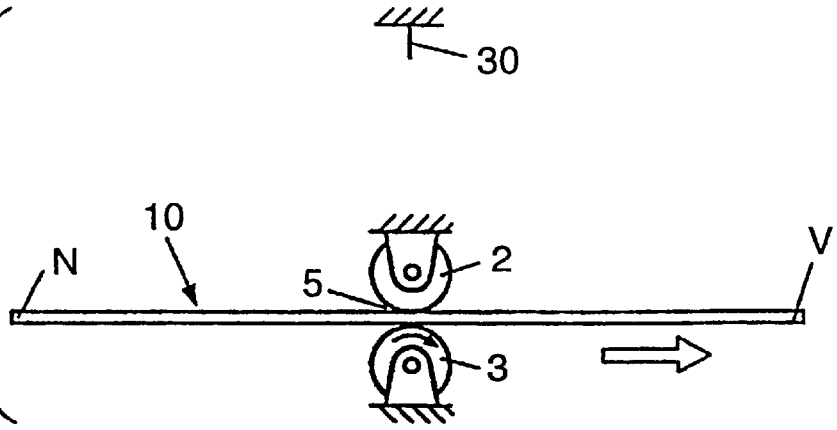
FIGS. 4*a* to 4*c* show a further example for a blank to be rounded in accordance with the invention.
Figure 4B:
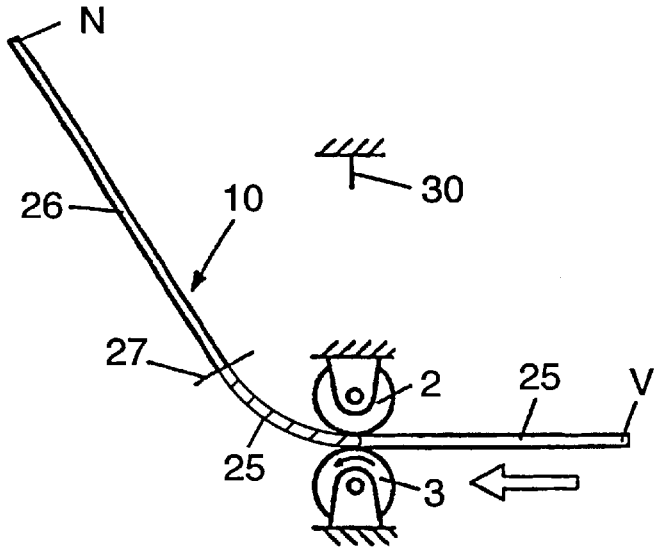
Figure 4C:
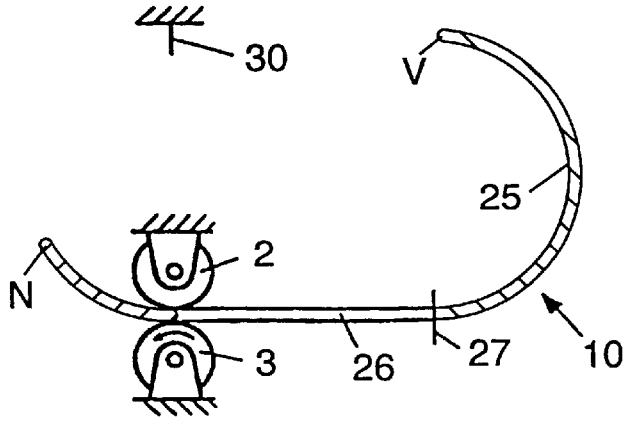

FIGS. 4*a* to 4*c* show a further embodiment of the method according to the invention. FIG. 4*a* shows how the blank 10 has been fed halfway through the rounding apparatus 1 with rolls 2, 3 parted, since no rounding has taken place. In FIG. 4*b* the rounding operation has started with reverse feed: a first part region 25 is undergoing rounding, which is proceeding from the center of the blank towards the leading edge V. When rounding of the first part region 25 is complete, the leading edge V will be located at the run-in point 5. A second part region 26 of the blank 10 remains unaffected. The blank 10 is then drawn through the rounding apparatus with forward feed until the trailing edge N has reached the run-in point 5 (this is with the rolls 2, 3 in the parted position as the second part region 26 passes through). FIG. 4*c* shows how the second part region 26 is rounded, starting from the trailing edge N and moving towards the start 27 of the first part region 25. When rounding is complete, the situation is as shown in FIG. 3*d*.

In FIGS. 3*a* to 3*d*, rounding of the two part regions has been performed with different feed directions; in FIGS. 4*a* to 4*c*, with the same feed direction. In both cases, however, the rounding of the second part region 21, 26 has proceeded towards the first part region (20, 25), with the result that the final position of the edges V, N is not at the run-in point 5. Similarly it falls within the scope of the invention to perform the rounding in any desired number of part regions (but in at least two), provided rounding in one part region proceeds towards another part region. With this proviso, straight and curved part regions can be combined to form sheet-metal bodies of any desired profiles. Nor are the profiles produced necessarily closed ones, as the device 30 can be configured for semi-open profiles. The device 30 is preferably arranged in a plane passing through the axes of rotation of the rolls 2, 3, as shown in the figures.

Although this invention has been shown and described with respect to the detailed embodiments thereof, it will be understood by those skilled in the art that various changes in form and detail thereof may be made without departing from the spirit and scope of the invention. For example, the invention extends not only to sheet metal, especially with the sizes stated in the introductory part of the description, but also to any metallic or non-metallic plastically deformable material where rounding is attended by the problem of the present invention.

What is claimed is:

1. A method for rounding a blank having a leading edge and a trailing edge, comprising the steps of:

providing a rounding apparatus having at least two rounding rolls;

providing a stationary catch rail separated from the rounding rolls;

rounding a predetermined first part region of the blank in a first feed direction; and rounding a predetermined second part region of the blank in a second feed direction opposite the first feed direction after the predetermined first part region has been rounded;

wherein the second feed direction is such that rounding of the predetermined second part region proceeds towards the previously rounded predetermined first part region, and the first part region and the second part region are disposed on opposite sides of the catch rail after the rounding steps.

2. The method of claim 1, wherein a total of two predetermined part regions are rounded, and the predetermined first and second part regions each cover substantially 50% of the area of the blank.

3. The method of claim 2, wherein within the step of rounding the first predetermined first part region, the blank is rounded from a leading edge, and after the first predetermined first part region is rounded, the blank continues to be fed in the same direction towards a trailing edge with the rounding rolls of the rounding apparatus held in an inactive position to prevent rounding of the second predetermined part region.

4. The method of claim 3, wherein within the step of rounding the predetermined second part region begins at the trailing edge of the blank.

5. The method of claim 4, wherein the rounding of the predetermined second part region continues until the trailing edge comes into contact with the catch rail, which catch rail defines an edge position for the blank.

6. A method for rounding a blank in a rounding apparatus, comprising the steps of:

rounding a first part region of the blank from a leading edge of the blank in a first direction toward the center of the blank within the rounding apparatus;

feeding a second part region of the blank through the rounding apparatus in the first direction without plastically deforming the blank, to a trailing edge of the blank;

rounding the second part region of the blank from the trailing edge in a second direction that is opposite the first direction, until either the trailing edge operatively interacts with a stationary device for defining the edge position.

7. A method for rounding a blank, comprising the steps of:

providing a rounding apparatus having at least two rounding rolls;

positioning the blank between the rounding rolls such that a first part region of the blank is disposed on one side of the rounding rolls and a second part region of the blank is disposed on a side of the rounding rolls opposite the side where the first part region is disposed;

rounding the first part region of the blank in a first direction toward a leading edge of the blank;

feeding the now-rounded first part region of the blank and the second part region of the blank through the rounding apparatus in a second direction, opposite the first direction, without plastically deforming the blank, until a trailing edge of the blank is disposed between the rounding rolls;

rounding the second part region of the blank from the trailing edge in the first direction, until either the trailing edge operatively interacts with a device for defining the edge position, or the blank is fully rounded.

8. An apparatus for rounding a blank that has a leading edge and a trailing edge, comprising:

a pair of rounding rolls, wherein the blank to be rounded is fed between the rounding rolls;

a stationary device for defining an edge position of the blank, wherein the device is disposed separate from the rounding rolls at a position to be adjacent the leading edge and trailing edge of a roll rounded on the apparatus; and a controller for selectively changing the feed direction and the working position of the rounding rolls.

9. The apparatus of claim 8, wherein one of the rounding rolls includes a compressively elastic layer on an exterior surface.

10. The apparatus of claim 8, wherein the device for defining the edge position is configured so that after the blank has been rounded the leading edge and the trailing edge are caught in guide elements, for onward axial transport of the rounded blank.

11. The apparatus of claim 10, wherein the device for defining the edge position is substantially aligned with a line extending through an axis of rotation of each of the rounding rolls.

* * * * *

UNITED STATES PATENT AND TRADEMARK OFFICE

CERTIFICATE OF CORRECTION

PATENT NO. : 6,725,699 B1
DATED : April 27, 2004
INVENTOR(S) : Eugen Müller

It is certified that error appears in the above-identified patent and that said Letters Patent is hereby corrected as shown below:

Title page,
Item [54], Title, please delete "CIRCULARY" and insert -- CIRCULARLY --.

Signed and Sealed this

Twenty-ninth Day of June, 2004

JON W. DUDAS
*Acting Director of the United States Patent and Trademark Office*